US009228404B1

(12) United States Patent
Jackson et al.

(10) Patent No.: US 9,228,404 B1
(45) Date of Patent: Jan. 5, 2016

(54) SLIP ASSEMBLY

(75) Inventors: Stephen L. Jackson, Richmond, TX (US); Randy A. Jones, The Woodlands, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 671 days.

(21) Appl. No.: 13/361,477

(22) Filed: Jan. 30, 2012

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01); *Y10T 29/49826* (2015.01); *Y10T 29/49995* (2015.01)

(58) Field of Classification Search
CPC ..... E21B 23/01; E21B 33/129
USPC ..... 166/118
See application file for complete search history.

(56) References Cited

U.S. PATENT DOCUMENTS

| | | | | |
|---|---|---|---|---|
| 3,127,198 | A * | 3/1964 | Orund | 285/123.6 |
| 5,131,468 | A * | 7/1992 | Lane et al. | 166/120 |
| 5,542,473 | A * | 8/1996 | Pringle | 166/120 |
| 6,354,372 | B1 * | 3/2002 | Carisella et al. | 166/118 |
| 2011/0088891 | A1 * | 4/2011 | Stout | 166/120 |

* cited by examiner

*Primary Examiner* — Robert E Fuller
(74) *Attorney, Agent, or Firm* — MH2 Technology Law Group, LLP

(57) ABSTRACT

Methods and apparatus associated with a slip assembly. The slip assembly comprises a plurality of slip segments, wherein each of the plurality of slip segments and a bonding substrate. The slip segments comprise: a first end having a plurality of teeth; a second end opposite the first end; and a transition section between the first end and the second end. The bonding substrate is disposed within the transition sections.

26 Claims, 3 Drawing Sheets

SLIP ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

Embodiments disclosed herein relate to apparatuses and methods used in well operations. More specifically, embodiments disclosed herein relate to slip assemblies used in well operations. More specifically still, embodiments disclosed herein relate to cageless slip assemblies used in well operations.

2. Background Art

This section of this document introduces various information from the art that may be related to or provide context for some aspects of the technique described herein and/or claimed below. It provides background information to facilitate a better understanding of that which is disclosed herein. This is a discussion of "related" art. That such art is related in no way implies that it is also "prior" art. The related art may or may not be prior art. The discussion in this section is to be read in this light, and not as admissions of prior art.

Slip assemblies are used in well completion operations to secure downhole tools in the well bore. For examples, slip assemblies may be run downhole on a tubular string and then radially expanded to secure packers, anchors, plugs, or other downhole tools to the sidewall of a well or well casing.

Typical slip assemblies include a cage or springs that prevent the slips from contacting the annular area, thereby allowing the slip assemblies, to be deployed to a specified depth without becoming stuck or prematurely setting. Once at the specified depth, the slips are released from the case or spring system using mechanical or hydraulic, systems, thereby allowing the slips to radially expand into contact with the well or casing wall. Such cage and spring systems occupy annular space on the tool, thereby reducing the cross-sectional area through which a tool, such as a packer, anchor, or plug may be run. However, the cage and/or spring systems are required to prevent premature actuation of the tool.

Accordingly, there exists a need for a slip assembly that may be run downhole without the requirement of a cage or spring system to prevent premature tool actuation.

The present invention is directed to resolving, or at least reducing, one or all of the problems mentioned above.

SUMMARY OF THE DISCLOSURE

In various aspects and embodiments, the disclosure herein relates to methods and apparatus associated with a slip assembly.

In a first aspect, a slip assembly comprises a plurality of slip segments, wherein each of the plurality of slip segments and a bonding substrate. The slip segments comprise: a first end having a plurality of teeth; a second end opposite the first end; and a transition section between the first end and the second end. The bonding substrate is disposed within the transition sections.

In a second aspect, a method of manufacturing a slip assembly comprises forming a plurality of teeth on at least one of a first end and a second end of a tubular; forming a recess on the tubular, wherein the recess is formed between the first and second ends; milling the tubular to form a plurality of slip segments; and bonding the plurality of slip segments to form an assembled slip assembly.

In a third aspect, a method of deploying a downhole tool comprises: running the downhole tool comprising a slip assembly into a well, wherein the slip assembly comprises a plurality of bonded slip segments; breaking the bonds of the slip segments; radially expanding the plurality of slip segments; and engaging a wall of the well with the slip assembly.

In a fourth aspect, a method of manufacturing a slip assembly comprises, the method comprising: forming a plurality of slip segments, wherein the plurality of slip segments comprise a first end, a second end, and a transition between the first and second ends, and wherein at least one, of the first and second ends have a plurality of teeth; and bonding the plurality of slip segments to form an assembled slip assembly.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

In general, embodiments disclosed herein relate to apparatuses and methods used in well operations. More specifically, embodiments disclosed herein relate to slip assemblies used in well operations. More specifically still, embodiments disclosed herein relate to cageless slip assemblies used in well operations.

As explained above, traditional slip assemblies used in downhole tools, such as packers, anchors, plugs, and the like, require use of a cage or spring system to retain slips during downhole deployment. The cage or spring systems take up valuable annular space, as the cage and/or spring systems may extend radially from the tool body. Because the cage and/or spring systems may have an outside diameter that is greater than the slips or other tool portions, the cage and/or spring systems may reduce the cross-sectional area through which the downhole tool may be deployed.

Embodiments disclosed herein provide slip assemblies that do not require the use of a cage or spring system. Rather than rely on cage or spring systems to prevent the premature actuation of the slip assemblies, the slips are divided then bonded in place. The bonds are broken in a controlled fashion once the tool has reached the desired depth.

Figure 1:
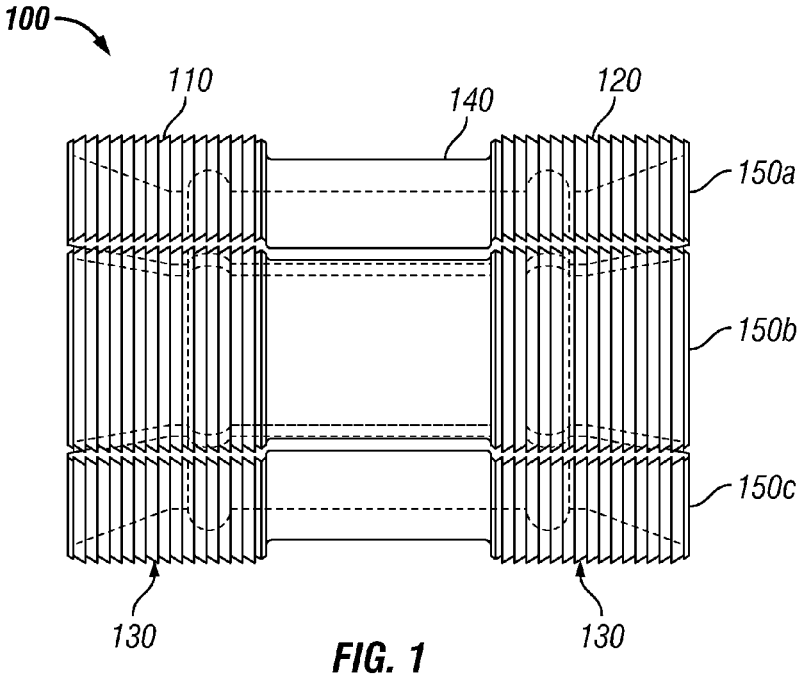
FIG. 1 is a partial cross-sectional view of a slip assembly according to embodiments of the present disclosure.

Referring to FIG. 1, a partial cross-sectional view of a slip assembly 100 according to embodiments of the present disclosure is shown. In this embodiment, slip assembly 100 has a first end 110 and a second end 120. As illustrated, the first end 110 and the second end 120 each have a plurality of teeth 130. The plurality of teeth 130 extend radially from the slip assembly 100, and are configured to engage a well or casing wall after actuation. In certain embodiments, only one of the first end 110 or second end 120 may include teeth 130. In such an embodiment, actuation of the slip assembly may thus only cause the teeth 130 of either first end 110 or second 120 to engage a well wall.

Slip assembly 100 further includes a transition section 140 located between first end 110 and second end 120. Transition section 140 is recessed, such that the outer diameter of transition section 140 may be less than the outer diameter of first end 110 and second end 120. In embodiments where only one of first end 110 and second end 120 have teeth 130, the transition section may have an outer diameter that is less than the end 110/120 that has teeth 130. The transition section 140 in this embodiment has a constant outside diameter, however, in alternate embodiments, the transition section 140 may have grooves or other geometric profiles.

Slip assembly 100 is divided into a plurality of slip segments 150*a*, 150*b*, and 105*c*. The plurality of slip segments 150*a*, 150*b*, and 150*c* are milled from a tubular material, so the plurality of slip segments 150*a*, 150*b*, and 150*c* corresponded to one another. The manufacturing process for slip assembly 100 is described in detail below. Depending on the requirements of the operation, the number of slip segments 150 into which slip assembly 100 is divided may vary. For example, in certain embodiments, the slip assembly 100 may be divided into two, three, four, or more slip segments 150. In such embodiments, the segments may be 180° segments, 120° segments, or 90° segments, respectively. However, in other embodiments, such as when smaller diameter casing is used, e.g., 3-6 inch casing, six to eight segments may be preferable. In other embodiments, such as when larger diameter casing is used, e.g., 12-36 inch casing, as may be used in offshore wells, the slip assembly 100 may be divided into 36 or more segments. The number of slip segments 150 that slip assembly 100 is divided into may be as many as is practical to occupy the full 360° circumference of the slip assembly 100. The same is generally true for different diameters of so-called "open hole" wells (with no casing).

Figure 2:
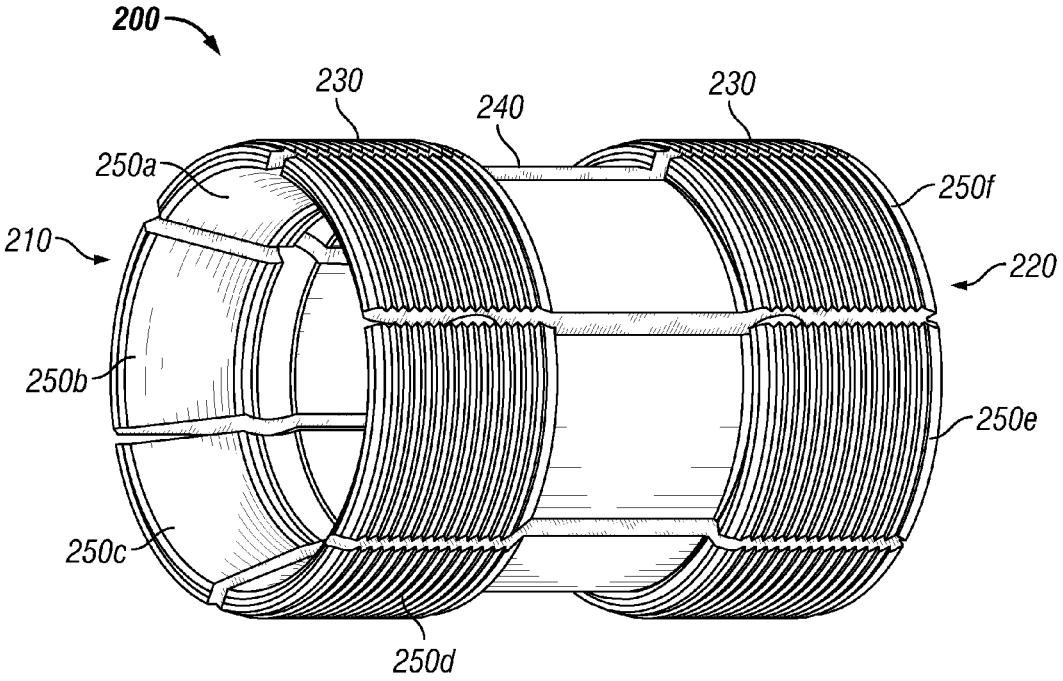
FIG. 2 is a perspective view of a slip assembly according to embodiments of the present disclosure.

Referring to FIG. 2, a perspective view of a slip assembly 200 according to embodiments of the present disclosure is shown. FIG. 2 is a perspective view of the slip assembly 200 of FIG. 1, i.e., slip assembly 100, and illustrates the slip assembly 200 prior to connecting individual slip segments 250 with a bonding substrate. Slip assembly 200 has a first end 210 and a second end 220. As illustrated, the first end 210 and the second end 220 each have a plurality of teeth 230. Slip assembly 200 further includes a transition section 240 located between first end 210 and second end 220.

FIG. 2 illustrates a slip assembly 200 that has six slip segments 250*a-f*. Each slip segment 250*a-f* is 60°, so that when assembled, the slip segments 250*a-f* form a complete 360 circumference. As may be readily seen in FIG. 2, transition 240 extends around the entire circumference of slip assembly 200; however, in alternate embodiments, transition 240 may not be continuous around the entire circumference. For example, transition 240 may extend for a limited portion of the circumference, such as around the portions of slip assembly 200 where slip segments 250*a-f* are divided.

Figure 3:
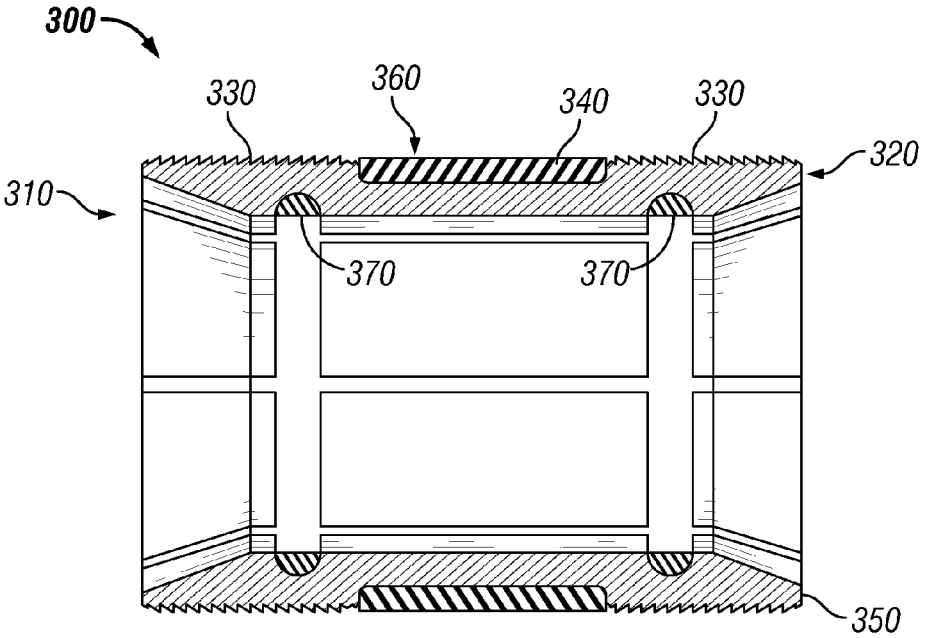
FIG. 3 is a cross-sectional view of a slip assembly according to embodiments of the present disclosure.

Referring to FIG. 3, a cross-sectional view of a slip assembly 300 according to embodiments of the present disclosure is shown. FIG. 3 illustrates slip assembly 300 after individual slip segments 350 have been bonded. Slip assembly 300 has a first end 310 and a second end 320. As illustrated, the first end 310 and the second end 320 each have a plurality of teeth 330. Slip assembly 300 further includes a transition section 340 located between first end 310 and second end 320.

Slip assembly 300 further includes a bonding substrate 360 disposed in transition 340. The bonding substrate 360 may include various substances capable of bonding slip segments 350 together. Examples of bonding substrates 360 may include various elastomers and/or polymers, including polymer resins and fiber composites. The elastomer and/or polymers may be applied to transition 340 to create a laminated tubular section of slip assembly 300.

Along the internal diameter of slip assembly 300, a secondary bonding substrate 370 may be applied to hold slip segments 350 in place during the process of connecting/bonding the individual slip segments 350. In alternate embodiments, secondary bonding substrate 370 may be used in place of bonding substrate 360. Depending on the requirements of the slip assembly 300, bonding substrate 360 and secondary bonding substrate 370 may be formed of the same material, or alternatively, may be formed from different materials. For example, bonding substrate 360 may be an elastomer bond, while secondary bonding substrate 370 may be a polymer bond. Either may be reinforced with fiber in a matrix composite.

Figure 4:
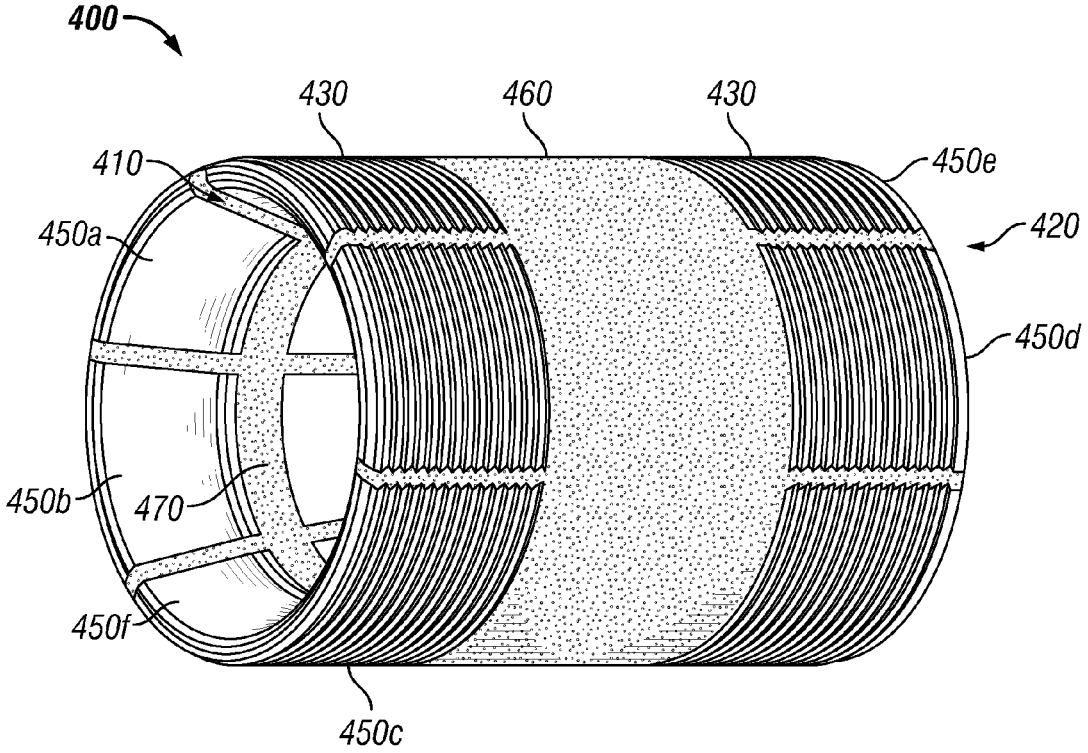
FIG. 4 is a perspective view of a slip assembly according to embodiments of the present disclosure.

Referring to FIG. 4, a perspective view of a slip assembly 400 according to embodiments of the present disclosure is shown. FIG. 4 illustrates slip assembly 400 in an assembled condition, wherein individual slip segments 450 have been connected through the use of a bonding substrate 460.

Slip assembly 400 has a first end 410 and a second end 420. As illustrated, the first end 410 and the second end 420 each have a plurality of teeth 430. Slip assembly 400 further includes a bonding substrate 460 located between first end 410 and second end 420. FIG. 4 further illustrates slip assembly 400 that has six slip segments 450*a-f*. Each slip segment 250*a-f* is 60°, so that when assembled, the slip segments 450*a-f* form a complete 360 circumference.

In this embodiment, bonding substrate 460 is disposed in the transition portion (not shown) around the entire circumference of slip assembly 400. Thus, individual slip segments 450*a-f* are held in place so as to form slip assembly 400. Additionally, secondary bonding substrate 470 is disposed along the inner diameter of slip assembly 400, thereby providing an additional connection between the slip segments 450*a-f*.

Figure 5:
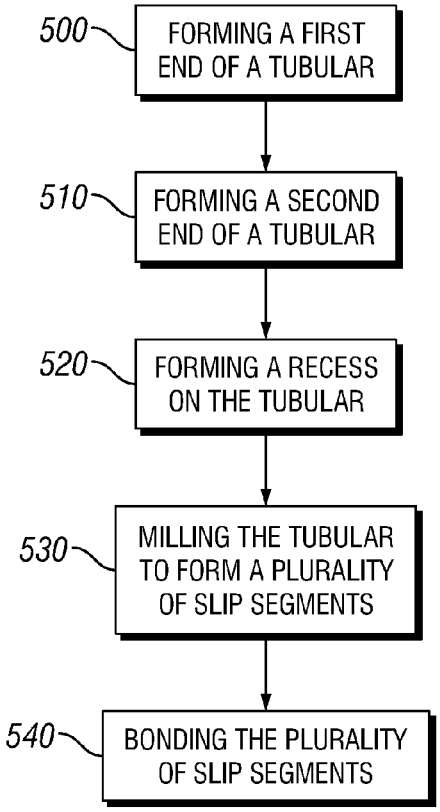
FIG. 5 is a flow chart diagram of a method of forming a slip assembly according to embodiments of the present disclosure.

Referring to FIG. 5, a flow chart diagram of a method for manufacturing a slip assembly according to embodiments of the present disclosure is shown. In manufacturing a slip assembly, a tubular portion is selected for a particular application. Examples of types of tubular that may be used include metallic tubulars, such as steel or other metals, as well as non-metallic tubulars, such as fiberglass, carbon, or ceramics.

In manufacturing the slip assembly, a first end of the tubular is formed (500) to include a plurality of teeth. The first end may be formed by, for example, milling a portion of the tubular to a selected slip profile. Similarly, a second end of the tubular is formed 510. The second end of the tubular may be formed to include teeth, or may be formed to match an alternative slip profile. Those of ordinary skill in the art will appreciate that the plurality of teeth may be formed to include conventional tooth patterns as known in the oilfield industry.

In addition to forming (500 and 510) the first and second ends, a recess is formed (520) on the tubular between the first and second ends. The depth of the recess may be selected based on the requirements of a particular slip assembly or based on operational constraints. For example, the depth of the recess may be determined based on a volume of bonding substrate that is required to hold individual slip segments in place.

The method further includes milling (530) the tubular to form a plurality of slip segments. During the slip segment milling (530), the slip assembly may be divided into individual slip segments by milling linearly, or longitudinally, along the length of the tubular. As discussed above, the number of slip segments created may vary based on the requirements of the downhole operation and/or the specifics of the well, such as the diameter of the well bore or casing. In certain embodiments, an inner diameter ring may be disposed in the tubular prior to milling (530), such that the individual slip segments are held in place throughout the remainder of the manufacturing process. If used, an inner diameter ring may be removed any time after the slip segments are bonded.

After the slip segments are milled (530), the plurality of slip segments may be bonded (540) to form an assembled slip assembly. The bonding process may include applying an elastomer or polymer substrate to the transition or recessed section of the slip assembly. In certain embodiments, the bonding (540) may further include applying a secondary substrate along the inner diameter of the slip assembly, such as along the area in which an inner diameter ring was previously disposed.

After the slip assembly is assembled, the slip assembly may be disposed along a downhole tubular string for disposition into a well. Each slip segment has a load bearing that contacts the mandrel preventing the slip from moving upward/downward into the slip cones and expanding into the well bore or casing. The only way that the slip can be expanded is to have the slip cone hydraulically or mechanically pushed into the cageless slip causing the slip to expand over the load bearing and outward into the well bore or casing.

The methods of manufacturing described herein are by way of example and illustration particular methods by which slip assemblies according to embodiments of the present disclosure may be formed. In alternative embodiments, additional steps may be undertaken or steps may be performed in different orders than expressly described herein. For example, the order that individual portions of the tubular are milled may vary and still be within the scope of the present disclosure.

Alternate methods for manufacturing a slip assembly according to embodiments of the present disclosure may be used. In these embodiments, rather than form a plurality of teeth along a preformed tubular, individual slip segments are formed. The individual slip segments may be formed in a variety of ways, including, for example, casting or molding the individual slip segments. In such an embodiment, a metal or composite may be introduced into a preformed mold, allowed to set, and then the resultant product removed from the mold.

Depending on the forming technique, the casting or molding material may be in liquid or solid state during introduction to the mold, and thus the introduction of the material into the mold may vary depending on the specific properties of the materials. Additionally, the types of materials used may influence the way in which the materials set or cure. In certain embodiments, the materials may be introduced after heating, and thus cooling of the materials in the mold allows the materials to set or cure. In alternative embodiments, such as with the use of thermosetting materials, the materials may be introduced to the mold, heated to a specific temperature, and then allowed to cool, thereby setting or curing the materials.

The mold may include any of the various design features for the slip segments described above. For example, the mold may include a slip segment having first and second ends with a transition section therebetween, wherein at least one of the ends includes a plurality of teeth. In certain embodiments, the mold may include first and second ends with a transition section therebetween, wherein both the first and second ends have a plurality of teeth.

After the slip segments have been formed, by setting or curing in the molds, the slip segments are removed from the molds. The individual slip segments may then be bonded together to form a complete assembled slip assembly. The number of slip segments used in forming the assembled slip assembly may vary according to the requirements of the completion operation as described above. In bonding the slip segments, the individual slip segments may be wrapped around a material tube, such as a metal or composite tubular, and bonded together using a bonding substrate, such as a polymer or elastomeric material. After the bonding substrate has cured, the material tube may be removed. The bonding substrate thus holds the individual slip segments together as an assembled slip assembly.

In certain embodiments a bonding substrate may alternatively be applied along the inner diameter of the slip segments. In such an embodiment, rather than wrapping the slip segments around a material tube, the slip segments may be held in place from either end of the slip segments or by compressing the slip segments into place along the outer diameter of the slip segments. As explained above, in certain embodiments, a bonding substrate may be applied to both the outer diameter and the inner diameter of the slip segments when forming an assembled slip assembly.

The types of composites used in manufacturing the slip assemblies described above may vary based on specific operational requirements. Examples of composite materials that may be used include carbon fiber, ceramics embedded in metal matrices, carbon/carbon materials, metal matrix composites, polymer composites, and the like. Particular resins used in either the composite materials used to form the slip segments or the bonding substrate may also vary depending on operational requirements, but may include, for example, various epoxy and epoxy derivatives, polyesters, vinlyesters, and the like. Those of ordinary skill in the art will appreciate that the aforementioned examples of composite materials and resins are not meant to be exhaustive and are not introduced as a specific limitation of the present disclosure. Rather, the above listed materials are illustrative of types of materials that may be used in forming components of the present disclosure.

Figure 6:
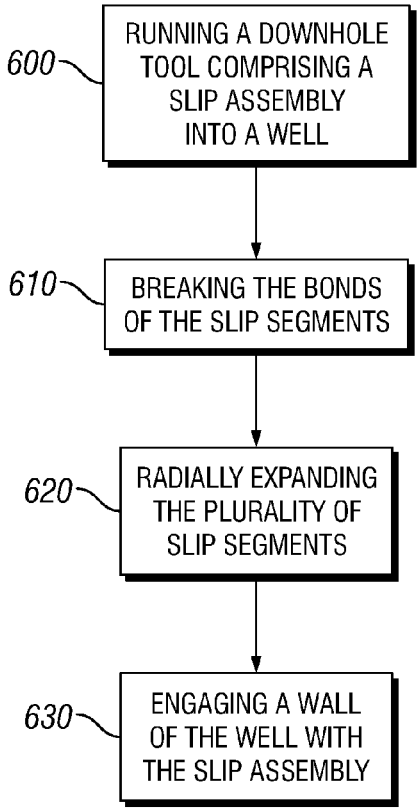
FIG. 6 is a flow chart diagram of a method for using a slip assembly according to embodiments of the present disclosure.

Referring to FIG. 6, a flow chart diagram of a method for using a slip assembly according to embodiments of the present disclosure is shown. During use of the slip assembly, initially, the slip assembly having a plurality of bonded slip segments is run (600) downhole. The slip assembly is lowered to a desired depth within the well, at which point the bonds holding the slip assembly segments are broken (610). The method for breaking the bonds may vary depending on the specific application for the slip assembly. For example, in certain embodiments, a hydraulic or mechanical force may be applied to the slip assembly that causes the slip segments to radially expand (620), thereby breaking/fracturing (610) the bonding substrate. In certain embodiments, the slip assembly may be self-setting. In such an embodiment, as the tool having the slip assembly is disposed into place within the well, the slip assembly self actuates. Depending on the particular embodiment in which the slip assembly is used, a separate setting tool may be disposed on the downhole tubular string; however, in certain applications, the setting tool may be an integral component of the particular tool in which the slip assembly is used.

As the slip segments radially expand (620), the teeth of the slip assembly engage (630) the wall of the well or casing, thereby locking a downhole tool in place. Those of ordinary skill in the art will appreciate that, as used herein, the wall of the well corresponds to any wall tubular, substrate, casing, or the like, with which the slip assembly may engage (630).

Advantageously, embodiments of the present disclosure may provide for slip assemblies that do not require the use of a cage or spring system. Because the slip assembly does not have a cage or spring system, the slip assembly provides greater radial slip extension, thereby allowing for use in larger inner diameter casing strings.

Additionally, downhole tools, such as packers, anchors, plugs, and the like that include such a slip assembly, may have a smaller outer diameter, which can be run in broader ranges of casing diameters. Thus, a single size tool may advantageously be used in a variety of applications.

Also advantageously, stronger tubular materials, such as steel may be used in place of low tensile ductile irons, which are used in certain applications, because the slip assembly is segmented prior to disposition downhole. Tools formed using low tensile ductile irons tend to fracture or prematurely actuate, thus, the slip assembly of the present disclosure may advantageously prevent tool damage, as well as premature actuation.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A slip assembly comprising:

a plurality of slip segments comprising a first slip segment and a second slip segment, the first and second slip segments each comprising:

an outer diameter surface;

a first end having a plurality of teeth disposed on the outer diameter surface;

a second end opposite the first end; and a transition section between the first end and the second end and adjacent to the plurality of teeth in a direction parallel to a longitudinal axis of the slip assembly; and a bonding substrate at least partially disposed within the respective transition sections of the first and second slip segments and in a space defined circumferentially between the first and second segments, wherein the bonding substrate is configured to at least partially fracture upon application of a predetermined radially outward force, so as to allow expansion of at least a portion of the slip assembly.

2. The slip assembly of claim 1, wherein the respective transition sections each comprise a recessed portion.

3. The slip assembly of claim 1, wherein the bonding substrate comprises at least one layer of an elastomer, at least one layer of a polymer, or a combination thereof.

4. The slip assembly of claim 1, wherein the second end comprises a plurality of teeth.

5. The slip assembly of claim 4, wherein the transition section is between the plurality of teeth of the first end and the plurality of teeth of the second end, as proceeding in the direction parallel to the longitudinal axis.

6. The slip assembly of claim 1, wherein the bonding substrate connects the first and second slip segments together at the respective transition sections.

7. The slip assembly of claim 1, wherein a first outside diameter of the slip assembly defined at the transition sections of the first and second slip segments is equal to or less than a second outside diameter of the slip assembly defined at the first end.

8. The slip assembly of claim 1, wherein the plurality of slip segments comprises at least four slip segments.

9. The slip assembly of claim 1, wherein the first and second slip segments each comprise a groove defined on an inner diameter surface thereof.

10. The slip assembly of claim 9, wherein the bonding substrate is positioned at least partially within the groove.

11. The slip assembly of claim 9, wherein the bonding substrate comprises a first bonding substrate positioned at least partially in the transition section and a second bonding substrate that is different from the first bonding substrate, the second bonding substrate being positioned in the groove.

12. The slip assembly of claim 1, wherein the first and second slip segments are at least partially spaced circumferentially apart so as to define a gap therebetween, wherein the bonding substrate received in the transition sections is also received into the gap.

13. The slip assembly of claim 1, wherein the plurality of slip segments are at least partially formed from a composite material.

14. The slip assembly of claim 1, wherein a portion of an inner diameter surface of the plurality of slip segments is inclined relative to the longitudinal axis, such that an inner diameter of the plurality of slip segments increases as proceeding toward an end thereof.

15. The slip assembly of claim 1, wherein the first and second slips segments each further comprise an inner diameter surface facing towards the longitudinal axis, and wherein the outer diameter surface faces away from the longitudinal axis.

16. The slip assembly of claim 1, wherein:

a portion of an inner diameter surface of the plurality of slip segments is inclined relative to the longitudinal axis, such that an inner diameter the plurality of slip segments increases as proceeding toward an end thereof, and the plurality of slip segments are configured to engage a slip cone at least at the portion of the inner diameter surface that is inclined, to drive the portion of the plurality of slip segments radially outward.

17. A method of manufacturing a slip assembly, the method comprising:

forming a plurality of teeth on an outer diameter surface of at least one of a first end and a second end of a tubular;

forming a recess on the tubular, wherein the recess is between the first and second ends;

cutting the tubular to form a plurality of slip segments; and bonding the plurality of slip segments using a bonding substrate disposed at least in a space defined circumferentially between at least two of the plurality of slip segments, to form an assembled slip assembly, wherein the recess is positioned adjacent to the plurality of teeth in a direction parallel to a longitudinal axis of the assembled slip assembly, wherein the bonding substrate is configured to at least partially fracture upon application of a predetermined radially outward force, so as to allow expansion of at least a portion of the slip assembly.

18. The method of claim 17, wherein the cutting the tubular comprises milling the tubular linearly.

19. The method of claim 17, wherein the bonding comprises connecting the plurality of slip segments using at least one of an elastomer or a polymer.

20. The method of claim 17, further comprising forming a plurality of teeth on both the first and second ends of the tubular.

21. The method of claim 17, wherein the cutting comprises milling the tubular to form at least four slip segments.

22. The method of claim 17, wherein the bonding comprises bonding the outer surface of the plurality of slip segments.

23. The method of claim 22, wherein the plurality of slip segments are bonded at the recess.

24. A method of manufacturing a slip assembly, the method comprising:

forming a plurality of slip segments, wherein the plurality of slip segments comprise a first end, a second end, and a transition section between the first and second ends, and wherein at least one of the first and second ends have a plurality of teeth on an outer diameter surface of the plurality of slip segments; and bonding the plurality of slip segments to form an assembled slip assembly, wherein bonding comprising forming a bonding substrate that is configured to at least partially fracture upon application of a predetermined radially outward force, so as to allow expansion of at least a portion of the slip assembly, wherein the transition section is between the first and second ends and adjacent to the plurality of teeth in a direction parallel to a longitudinal axis of the assembled slip assembly and wherein the bonding substrate is disposed at least in a space defined circumferentially between at least two circumferential ends of two circumferentially-adjacent slip segments of the plurality of slip segments.

25. The method of claim 24, wherein the forming comprises molding the plurality of slip segments or milling a tubular.

26. A slip assembly comprising:

a plurality of slip segments comprising a first slip segment and a second slip segment, the first and second slip segments each comprising:

a first end having a plurality of teeth;

a second end opposite the first end; and a transition section between the first end and the second end and adjacent to the plurality of teeth in a direction parallel to a longitudinal axis of the slip assembly; and a bonding substrate at least partially disposed within the respective transition sections of the first and second slip segments and in a space defined circumferentially between the first and second slip segments, wherein the bonding substrate is configured to at least partially fracture upon a application of a predetermined radially outward force, so as to allow expansion of at least a portion of the slip assembly, wherein a portion of an inner diameter surface of the plurality of slip segments is inclined relative to the longitudinal axis, such that an inner diameter of the plurality of slip segments increases as proceeding toward an end thereof, wherein the plurality of slip segments are configured to engage a slip cone at least at the portion of the inner diameter surface that is inclined, to drive the portion of the plurality of slip segments radially outward, and wherein the plurality of teeth are located on an outer diameter surface of the plurality of slip segments.

* * * * *